US006425546B1

(12) United States Patent
Ohashi et al.

(10) Patent No.: US 6,425,546 B1
(45) Date of Patent: Jul. 30, 2002

(54) RIBBON WINDING PREVENTING METHOD AND TRAVERSE DRUM

(75) Inventors: Kenji Ohashi, Uji; Ichiro Hidaka; Norio Kubota, both of Kyoto, all of (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/689,586

(22) Filed: Oct. 13, 2000

(30) Foreign Application Priority Data

Oct. 15, 1999 (JP) ..... 11-293979
Aug. 22, 2000 (JP) ..... 2000-251051

(51) Int. Cl.[7] ..... B65H 54/38; B65H 54/28

(52) U.S. Cl. ..... 242/477.4; 242/477.9; 242/483.6

(58) Field of Search ..... 242/477.4, 477.5, 242/477.9, 482, 483.6

(56) References Cited

U.S. PATENT DOCUMENTS 3,690,579 A * 9/1972 Porter et al. ..... 242/477.5 X
4,767,071 A * 8/1988 Hirai ..... 242/477.2
5,044,571 A * 9/1991 Ohashi ..... 242/477.4
5,090,633 A * 2/1992 Ohashi ..... 242/477.4
5,857,638 A * 1/1999 Hermanns et al. ... 242/477.4 X

* cited by examiner

*Primary Examiner*—Michael R. Mansen
(74) *Attorney, Agent, or Firm*—Armstrong, Westerman & Hattori, LLP

(57) ABSTRACT

Although many conventional ribbon winding preventing methods have substantially solved a ribbon winding problem in terms of the appearance of a package, there is still a large difference between a ribbon winding layer and the other layers in, for example, unwinding performance for fast unwinding during a postprocess. In a configuration for using a traverse groove 11 formed in a traverse drum 6 to traverse and wind a yarn into a package 3, the traverse drum 6 has a plurality of continuous traverse grooves 11 for different winding values formed therein. This configuration also has means 24 for switching a yarn path to determine which of the plurality of continuous traverse grooves 11 for different winding values used to traverse the yarn. Means for detecting a diameter at which ribbon winding may occur is also provided to effect such control that the winding number for the traverse drum 6 is changed when a package diameter is close to the ribbon winding diameter.

7 Claims, 9 Drawing Sheets

RIBBON WINDING PREVENTING METHOD AND TRAVERSE DRUM

FIELD OF THE INVENTION

The present invention relates to the configuration of a winding device in an automatic winder, a double twister, a false twister, or the like and the configuration of a traverse drum for use in the winding device, and in particular, to a technique for preventing ribbon winding during production of winding packages to improve yarn quality.

BACKGROUND OF THE INVENTION

In conventional textile machines, automatic winders are well known which comprise a traverse drum having a traverse groove formed in its peripheral surface and through which a yarn unwound from a spinning bobbin or the like is traversed to produce a winding package rotationally driven by the traverse drum in contact therewith. Double twisters and false twisters are also known which comprise a traverse drum having a traverse groove formed therein to traverse a yarn.

In addition, since the yarn traversed through the traverse groove is sequentially wound around the winding package, its package diameter increases gradually. When the package diameter and the diameter of the traverse drum have a certain relationship, the ribbon winding occurs on the winding package. The ribbon winding is a phenomenon in which the yarn wound on the winding package passes through substantially the same yarn path during a certain period, so that an extremely small number of intersections of the yarn are formed on the package. A winding package in which the ribbon winding has occurred may cause sluffing or yarn breakage by entanglement of yarn (a process called "latching") during a postprocess when the yarn is unwound. Many methods for preventing ribbon winding on the winding package have been provided, including periodic braking of the drum or the package.

Although the above described ribbon winding preventing methods according to the prior art have substantially solved the ribbon winding problem in terms of the appearance of the package, there is still a large difference between ribboned layers and the other layers in, for example, winding performance for fast unwinding during the postprocess.

A method is thus well known which forms a shortened passage in part of the traverse groove formed in the traverse drum to change the winding value (number of winding) in order to enable two winding values for the traverse drum to be switched. This conventional configuration, however, requires the two winding values to be switched during a winding operation of an automatic winder or the like. For example, in a traverse drum with 2 winding values (2W) and 3 winding values (3W), the winding values is alternately changed for each traverse operation. Accordingly, complicated control is required and the yarn path must frequently be changed. Therefore, this method is not efficient.

The problems to be solved by the present invention have been described, and means for solving these problems will be explained below.

SUMMARY OF THE INVENTION

In the present invention for using a traverse groove formed in a traverse drum to traverse and wind a yarn into a package, the traverse drum has a plurality of continuous traverse grooves for different winding values formed therein.

The present invention has means for switching a yarn path to determine which of the plurality of continuous traverse grooves for different winding values is used to traverse the yarn.

In the present invention for using a traverse groove formed in a traverse drum to traverse and wind a yarn into a package, means for detecting a diameter of the package at which the ribbon winding occurs is provided to provide such control that the winding value for the traverse drum is changed near a diameter at which ribbon winding has occurred.

In the present invention, the traverse drum has a plurality of continuous traverse grooves formed therein and having different winding values.

In the present invention, the plurality of continuous traverse grooves are formed substantially completely independently.

In the present invention, a continuous traverse groove for 2 winding values and a continuous traverse groove for 2.5 winding values are formed.

In the present invention, a half or more of the plurality of continuous traverse grooves are independently formed and the remaining traverse grooves constitute a common passage.

In the present invention, a forward and backward portions of at least one continuous traverse groove have different winding values.

DETAILED DESCRIPTION OF THE PREFERRED EMBODIMENTS

Next, an embodiment of the present invention will be described with reference to the accompanying drawings.

Figure 1:
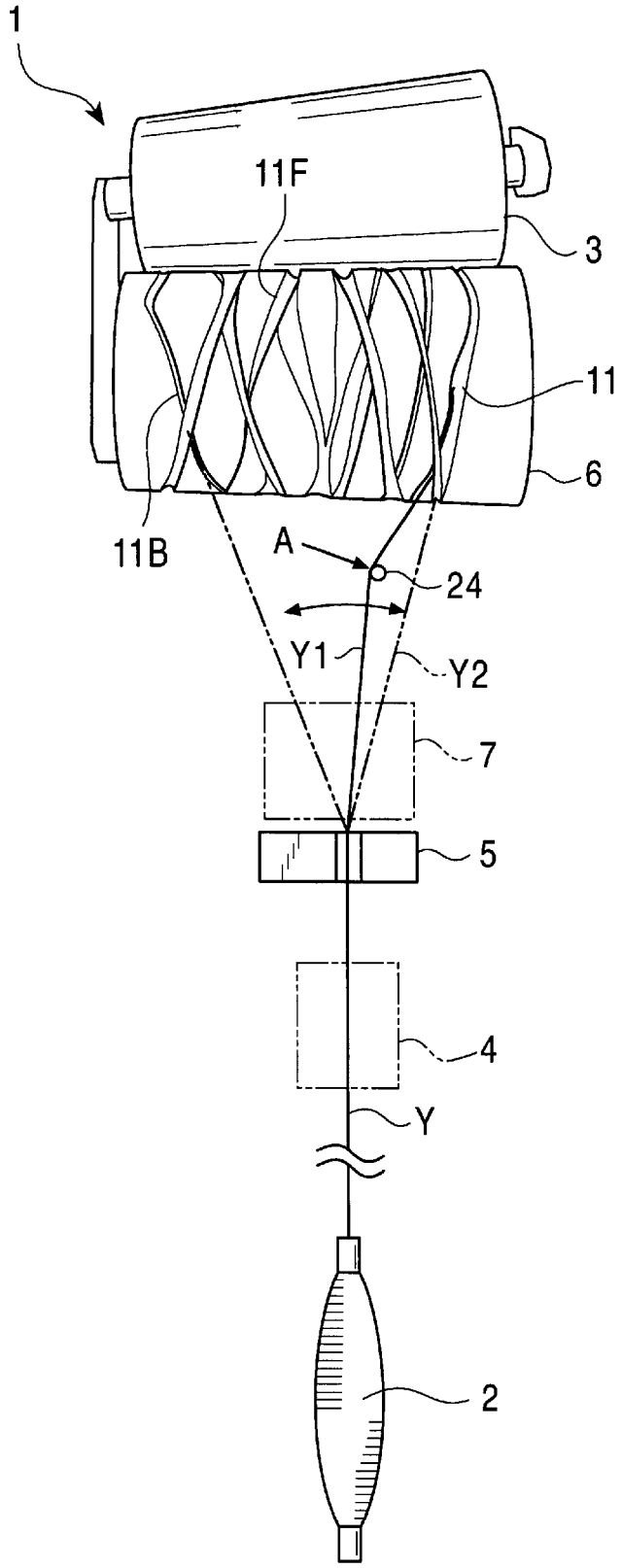
FIG. 1 is a schematic view showing the configuration of an automatic winder comprising a ribbon winding preventing device according to the present invention.

First, the configuration of an automatic winder will be explained with reference to FIG. 1, as an embodiment using a ribbon winding preventing device according to the present invention.

An automatic winder 1 is a device for rewinding a yarn from a spinning bobbin 2 produced by a ring spinning machine or the like, into a package 3.

The spinning bobbin 2 is conveyed on a machine base (not shown in the drawings) and placed at a predetermined position of the automatic winder 1. A yarn end on the spinning bobbin 1 is captured and a yarn Y is transferred upward. The yarn Y is tensed by a tension device 4, passed through a yarn defect detecting head 5, traversed by a traverse drum 6, and then wound into the package 3.

In addition, a splicer 7 is disposed on a yarn path leading from the yarn defect detecting head 5 to the traverse drum 6, to join the yarn after removal of a yarn defect if the defect has been found in the yarn Y or to join the yarn for a new spinning bobbin 2 that has replaced an empty bobbin. This allows several to several tens of spinning bobbins 2 to be wound into knot-less high quality packages 3.

The traverse drum 6 has a continuous traverse groove 11 formed in a drum surface. The traverse groove 11 comprises a traverse forward passage 11F for transferring the yarn leftward in FIG. 1 and a traverse backward passage 11B for transferring the yarn rightward so that the yarn Y is traversed leftward through the traverse forward passage 11F and then rightward through the traverse backward passage 11B before returning to the original position. The yarn Y is sequentially traversed through the traverse groove 11 in this manner and then wound into the package 3 driven by the traverse drum 6 in surface contact therewith.

The traverse drum 6 according to the present invention has two different types of traverse grooves 11 for different winding values (hereafter referred to as "W" as appropriate) formed therein to prevent ribbon winding as described above.

One of these two types is the traverse groove 11 for a normal operation adapted to have the traverse forward passage 11F and the traverse backward passage 11B both for 2.5W.

The other is the traverse groove 11 for a ribbon winding diameter operation having 3W for the traverse forward passage 11F and 2.5W for the traverse backward passage 11B, and an average drum winding value constituted by two traverse (two forward and backward operations) is 2.75W.

First, the traverse groove 11 for the normal operation will be described with reference to FIG. 2.

Figure 2:
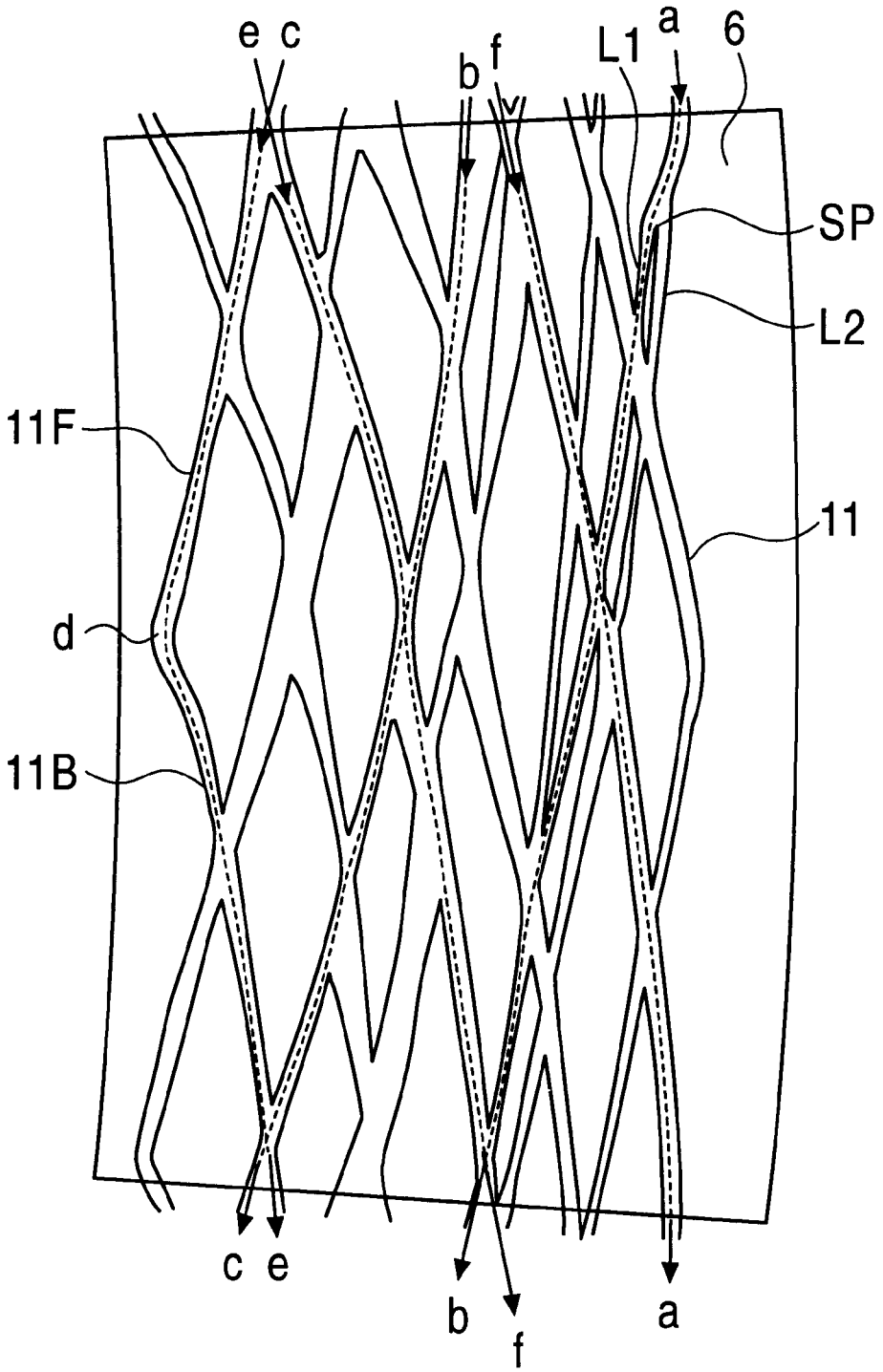
FIG. 2 is a development of a traverse drum showing a yarn path for a normal operation.

If the yarn Y is traversed using a point (a) in FIG. 2 as a starting point, the yarn Y passes through the traverse groove 11 as the traverse drum 6 rotates, that is, it moves from the point (a) through a branching portion SP and a groove L1 to a point (b). The yarn Y then moves from the point (b) to a point (c) and then from the point (c) to a point (d) to reach a right end of the traverse drum 6. That is, the traverse groove 11 joining the points (a), (b), (c), (d) constitutes the traverse forward passage 11F. Since the leftward movement of the yarn Y causes the traverse drum 6 to be rotated 2.5 times, a drum winding value for the traverse forward passage 11F is 2.5W.

The yarn Y further passes through the traverse groove (or guide) 11 as the traverse drum 6 rotates, in this case, it moves from the point (d) to a point (e), then from the point (e) to a point (f), and then from the point (f) to the point (a) to reach the right end of the traverse drum 6. That is, the traverse groove 11 joining the points (d), (e), (f), (a) constitutes the traverse backward passage 118. Since the rightward movement of the yarn Y causes the traverse drum 6 to be rotated 2.5 times, a drum winding value for the traverse backward passage 118 is 2.5W.

As described above, during the normal operation, the traverse drum 6 has formed therein the traverse groove with the forward passage for 2.5W and the backward passage for 2.5W.

Next, the traverse groove 11 for the winding operation at a certain package diameter which a ribbon winding occurs will be described with reference to FIG. 3.

Figure 3:
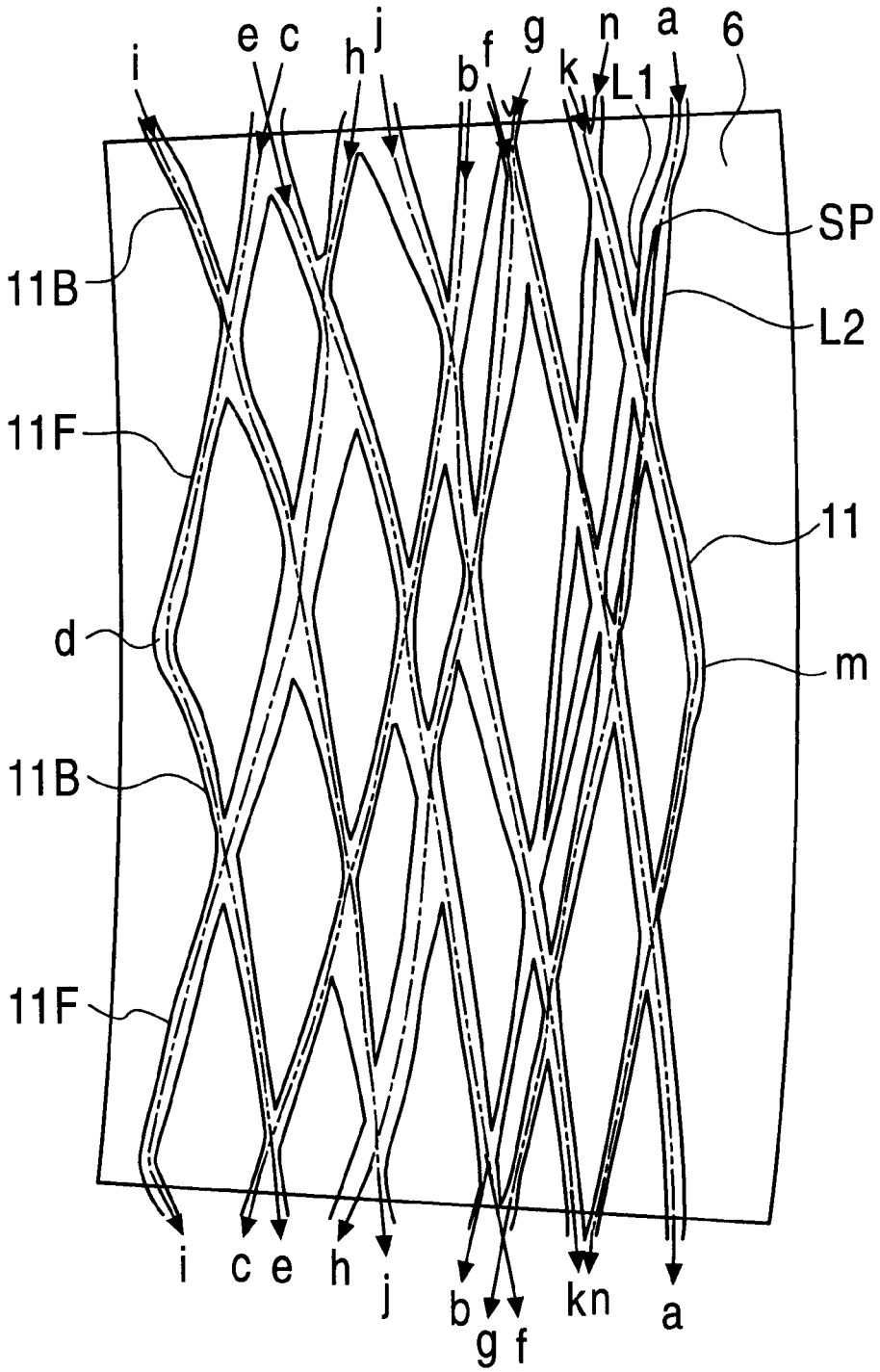
FIG. 3 is a development of the traverse drum showing a yarn path for a winding operation which a ribbon winding occurs in a certain package diameter.

If the yarn Y is traversed using a point (a) in FIG. 3 as a starting point, the yarn Y passes through the traverse groove 11 as the traverse drum 6 rotates, that is, it moves from the point (a) through a branching portion SP and a groove L2 to a point (g). The yarn Y then moves from the point (g) to a point (h) and then from the point (h) to a point (i) to reach a left end of the traverse drum 6. That is, the traverse groove 11 joining the points (a), (g), (h), (i) constitutes the traverse forward passage 11F. Since the leftward movement of the yarn Y causes the traverse drum 6 to be rotated 3 times, a drum winding value for the traverse forward passage 11F is 3W.

The yarn Y further passes through the traverse guide 11 as the traverse drum 6 rotates, in this case, it moves from the point (i) to a point (j), then from the point (j) to a point (k), and then from the point (k) to the point (m) to reach a right end of the traverse drum 6. That is, the traverse groove 11 joining the points (i), (j), (k), (m) constitutes the traverse backward passage 11B. Since the rightward movement of the yarn Y causes the traverse drum 6 to be rotated 2.5 times, a drum winding value for the traverse backward passage 11B is 2.5W. The yarn Y has thus performed one traverse (forward and backward operation), but further performs the second traverse operation without returning to the point (a).

The yarn Y is traversed leftward again from the point (m) and reaches a point (n), it then moves from the point (n) to a point (b), then from the point (b) to a point (c), and then from the point (c) to a point (d) to reach the left end of the traverse drum 6. This forms the traverse forward passage 11F for 3W joining the points (m), (n), (b), (c), (d) together. The yarn Y is further traversed rightward from the point (d) to move through the traverse backward passage 11B for 2.5W composed of the points (d), (e), (f), (a) to reach the right end of the traverse drum before returning to the starting point (a).

As described above, during the winding operation at a certain package diameter which the ribbon winding occurs, the traverse drum 6 has formed therein the traverse groove 11 for two forward-and-backward operations comprising the forward passage for 3W, the backward passage for 2.5W, the forward passage for 3W, and the backward passage for 2.5W. The average drum winding value during the winding operation at a certain package diameter which the ribbon winding occurs is determined by (3W+2.5W+3W+2.5W)/4=2.75W.

As described above, according to the present invention, the traverse drum 6 has the plurality of (in this embodiment, two types of) continuous traverse grooves 11 for different drum winding values formed therein.

In this embodiment, the two continuous traverse grooves 11 for different winding values are not completely mutually independent, but half or more (most) of the traverse grooves 11 are mutually independent, while the remaining portions (a part) thereof constitute a common path.

The above described traverse grooves 11 for the normal operation and the winding operation at a certain package diameter which the ribbon winding occurs each branch at the separating portion SP, and the traverse groove 11 is switched at this separating portion SP by a pin cylinder 24 acting as means disposed in the yarn path between the yarn defect detecting head 5 and the traverse drum 6 for switching the yarn path. The pin cylinder 24 is configured so as to be turned on and off and when turned on, projects to a position A in FIG. 1 to bend the yarn Y (the thus formed yarn path is denoted by Y1 in FIG. 1). This causes the yarn Y to be guided toward the groove L1 for the normal operation with the forward and backward operations both for 2.5W. Alternatively, when turned off, the pin cylinder 24 is withdrawn to release the tension exerted on the yarn Y (the thus formed yarn path is denoted by Y2 in FIG. 1). The yarn Y is then guided toward the groove L2 for the ribbon winding operation with an average winding value of 2.5W.

A ribbon winding preventing device and a controlling method therefor based on the above configuration will be explained.

During the normal operation, the yarn Y is sequentially wound into the winding package 3 through the traverse groove 11 for the above described normal operation. Then, when the package diameter R of the winding package 3 has a relation R=D×Wd/Wp (D: drum diameter of the traverse drum, Wd: traverse drum winding value, Wp: package winding value), ribbon winding may occur. If, for example, the drum diameter D=100 mm, Wd=2.5W, a ribbon winding package with Wp=1W will occur when the package diameter R is close to 250 mm. Likewise, a ribbon winding package with Wp=1.5W will occur when the package diameter R is close to 166 mm.

Figure 4:
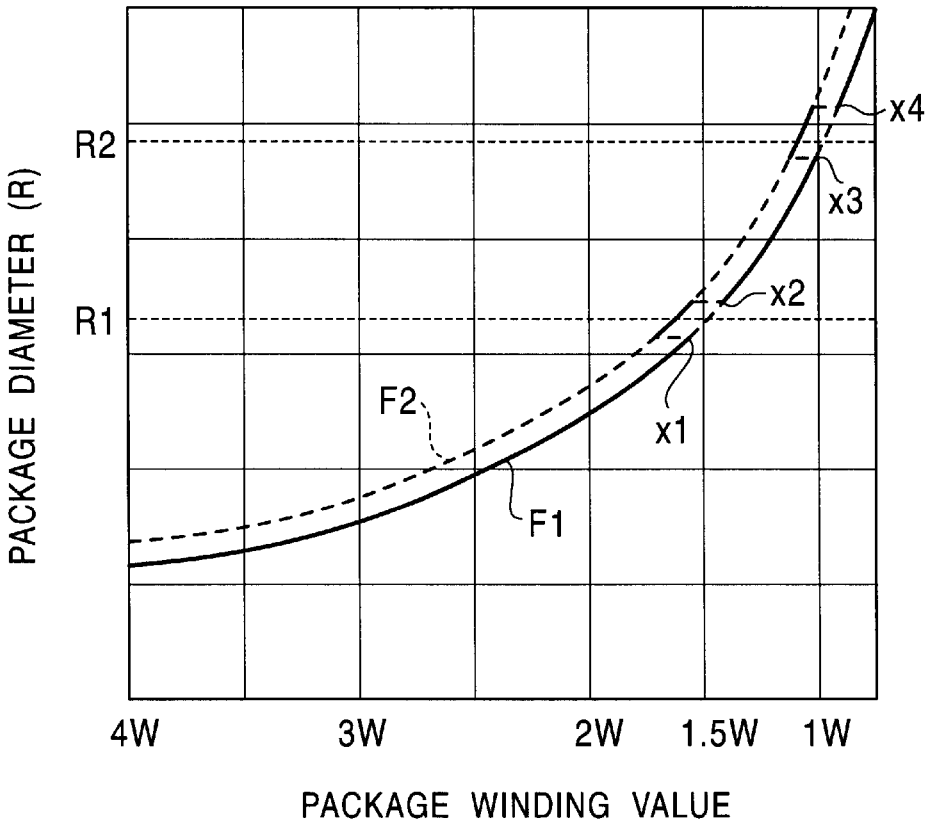
FIG. 4 shows the relationship between a package diameter and an occurrence of a ribbon winding.
Figure 5A:
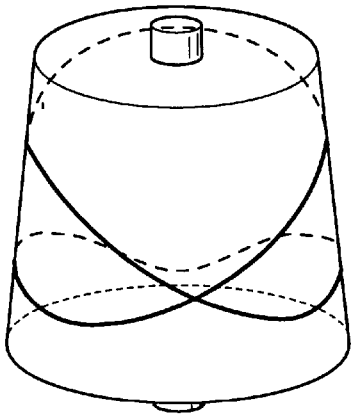
FIG. 5A shows ribbon winding with 1 winding value.
Figure 5B:
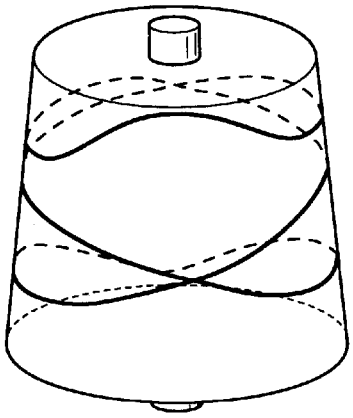
FIG. 5B shows ribbon winding with 1.5 winding values.

FIG. 4 shows the relationship between the package diameter R and the winding value of the ribbon winding. As shown in this figure, there are many ribbon winding packages such as those for 2W, 3W, . . . , but ribbon winding packages for 1W and 1.5W are particularly affected. FIG. 5A shows ribbon winding with 1W, while FIG. 5B shows ribbon winding with 1.5W, and the ribbon winding with 1W causes the yarn wound on the package to form only one yarn intersection thereon, whereas the ribbon winding with 1.5W causes the yarn to form only two yarn intersections thereon. Consequently, the yarn is free between one intersection and the next yarn intersection, so that sluffing is likely to occur during fast unwinding.

Thus, while the package diameter R is close to the diameters of the ribbon winding packages for 1W and 1.5W, the above described traverse groove 11 for the ribbon winding operation is used to shift the yarn path for the yarn wound on the package to prevent ribbon winding.

Although this embodiment is configured to prevent ribbon winding with 1W and 1.5W, configurations can be similarly provided for preventing ribbon winding with 0.75W, 1.25W, 1.75W, or 2W.

Figure 6:
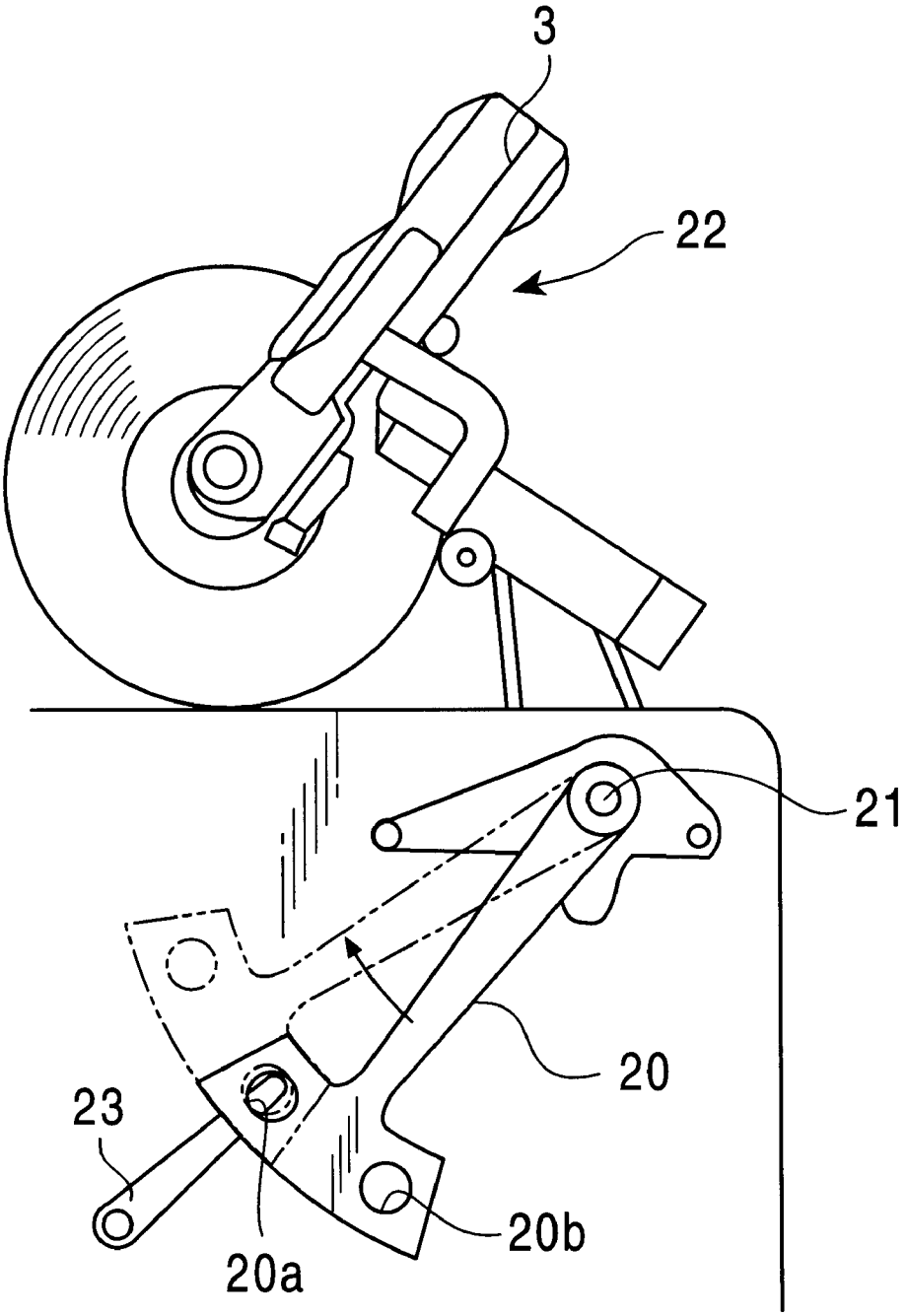
FIG. 6 shows a sensor lever.

FIG. 6 shows the configuration of the means for detecting a diameter of a package at which ribbon winding may occur. A sensor lever 20 can rotationally move around a shaft 21, and a cradle 22 for supporting the winding package 3 operates in conjunction with the sensor lever 20 and moves around the shaft 21 integrally therewith. The sensor lever 20 has ribbon winding diameter detecting holes 20a, 20b drilled at ends thereof and a proximity switch 23 disposed at a position lapping with a trajectory of the detecting holes 20*a*, 20*b* which is formed as the sensor lever 20 moves rotationally. The proximity switch 23 is initially turned on and is turned off while the detecting holes 20*a* are passing by.

As the diameter of the winding package 3 increases, the cradle 22 moves rotationally, and once the package diameter R reaches the value of a ribbon winding diameter for 1.5W, the detecting hole 20*a* passes over the proximity switch 23, which is then turned on. The pin cylinder 24 is then turned off to feed the yarn Y from the separating portion SP to the groove L2, so that the yarn Y is traversed through the traverse groove 11 for the ribbon winding operation. Then, once the detecting hole 20*a* has passed over the proximity switch 23 and moved away therefrom, the pin cylinder 24 is turned on again to return the operation to the normal one for a drum winding value of 2.5W. In FIG. 4, a graph F1 shows the relationship between the package diameter R for a drum winding value of 2.5W and the package winding value W, and a graph F2 shows the relationship between the package diameter R for a drum winding value of 2.75W and the package winding value W. As described above, the 2.5W operation is normally performed and the traverse drum is switched to the 2.75W operation when the package diameter is close to R1 at where the 1.5W ribbon winding may occur. That is, the portions shown by the solid line on the graphs F1 and F2 indicate actual winding values for the traverse drum, indicating that the operation is switched to the 2.75W one only between a point (x1) and a point (x2) on the graph F1.

Similarly, when the package diameter R reaches a value for the 1W ribbon winding, the detecting hole 20*b* turns on the proximity switch 23 to switch to the ribbon winding operation. When the detecting hole 20*b* has passed by, the operation returns to the normal one. As shown in FIG. 4, the winding value for the traverse drum 6 is switched to 2.75W when the package diameter is closed to R2 at which the 1W ribbon winding may occur (between a point (x3) and a point (x4)).

Thus, when the package diameter is close to the ribbon winding package diameter, the winding value for the traverse drum 6 is switched from 2.5W to 2.75W to shift the yarn path on the package to prevent ribbon winding.

In this manner, the present invention provides a configuration for using the traverse groove 11 to traverse and wind the yarn into the package 3, wherein the traverse drum 6 has the plurality of continuous traverse grooves 11 for different winding values formed therein and wherein the pin cylinder 24 acting as the means for switching the yarn path is provided to determine which of the plurality of continuous traverse grooves 11 is used to traverse the yarn. Consequently, the pin cylinder 24 can be turned on and off to change the winding value for the traverse drum 6, which is winding the yarn into the package.

In addition, since the means for detecting the ribbon winding occurring diameter which is composed of the sensor lever 20, the proximity switch 23, and other components is provided to change the winding value for the traverse drum 6 when the package diameter is close to the ribbon winding diameter, the winding value must be switched only when the package diameter is close to the ribbon winding diameter, thereby simplifying control to stabilize the winding operation. That is, if control is provided such that the winding value is constantly changed during the winding operation (regardless of whether or not the package diameter is close to the ribbon winding diameter) as in the prior art, complicated control is required and the yarn is not stably fed because the yarn path is frequently switched. The present invention, however, can prevent ribbon winding with the minimum required switching operation, thereby providing an efficient configuration.

Figure 7A:
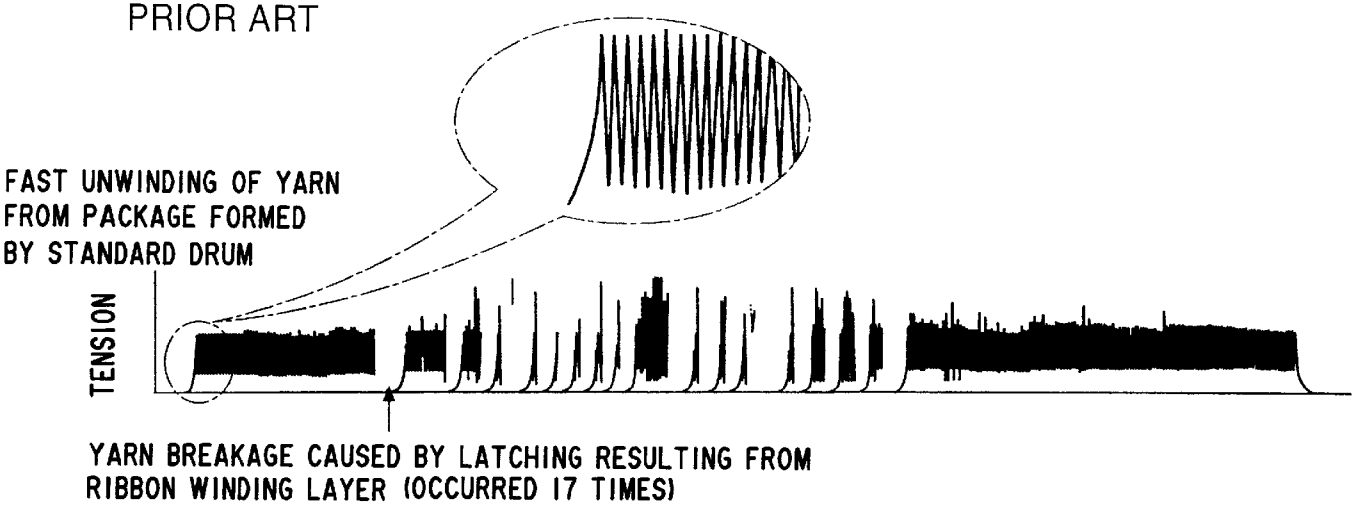
FIG. 7A PRIOR ART
FIGS. 7A and 7B are graphs comparing a standard traverse drum and the traverse drum according to the present invention in terms of performance, respectively.
Figure 7B:
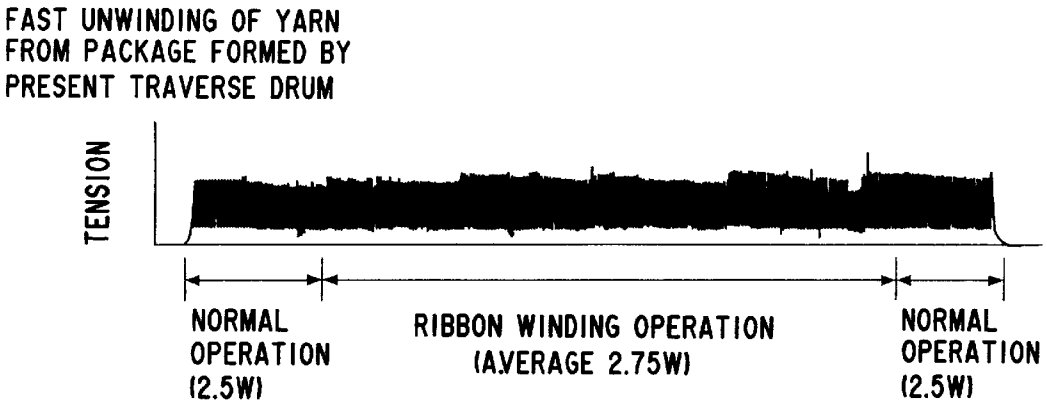

FIG. 7 is a graph comparing a standard drum and the traverse drum according to the present invention in terms of performance. The standard drum has a constant drum winding value. FIGS. 7A and 7B are graphs representing the tension of the yarn observed when it is unwound at a high speed (for example, 1,600 m/min.) near a 1W ribbon winding layer; FIG. 7A shows a package obtained by the standard drum, while FIG. 7B shows a package obtained by the traverse drum 6 according to the present invention. With the standard drum, the yarn breakage caused by latching occurred 17 times in the ribbon winding layer. On the other hand, with the traverse drum 6 according to the present invention, no yarn breakage caused by latching occurred.

In this embodiment, the yarn is wound at a drum winding value of 2.5W during the normal operation, whereas it is wound at a drum winding value of 2.75W during the winding operation at a certain package diameter which the ribbon winding occurs, but conversely, the normal operation may be based on 2.75W, which is then switched to 2.5W for the winding operation at a certain package diameter which the ribbon winding occurs. The latter case provides similar effects.

In addition, in this embodiment, the traverse drum 6 has the traverse groove 11 for the average 2.75W in addition to the traverse groove 11 based on 2.5W, but it may have a traverse groove for 3W in addition to a traverse groove based on 2W (2W×2W forward and backward operations) so that the yarn is wound at a drum winding value of 2W during the normal operation whereas it is wound with a switching operation 3W-2W-3W-2W . . . (that is, an average drum winding value of 2.5W) during the ribbon winding operation, thereby preventing ribbon winding.

Additionally, as the traverse drum having the plurality-of continuous traverse grooves for different winding values formed therein as described above, a traverse drum may be configured which has a traverse groove with a forward and backward paths both for 2.5W and a traverse groove with a forward and backward paths both for 2.0W.

Figure 8:
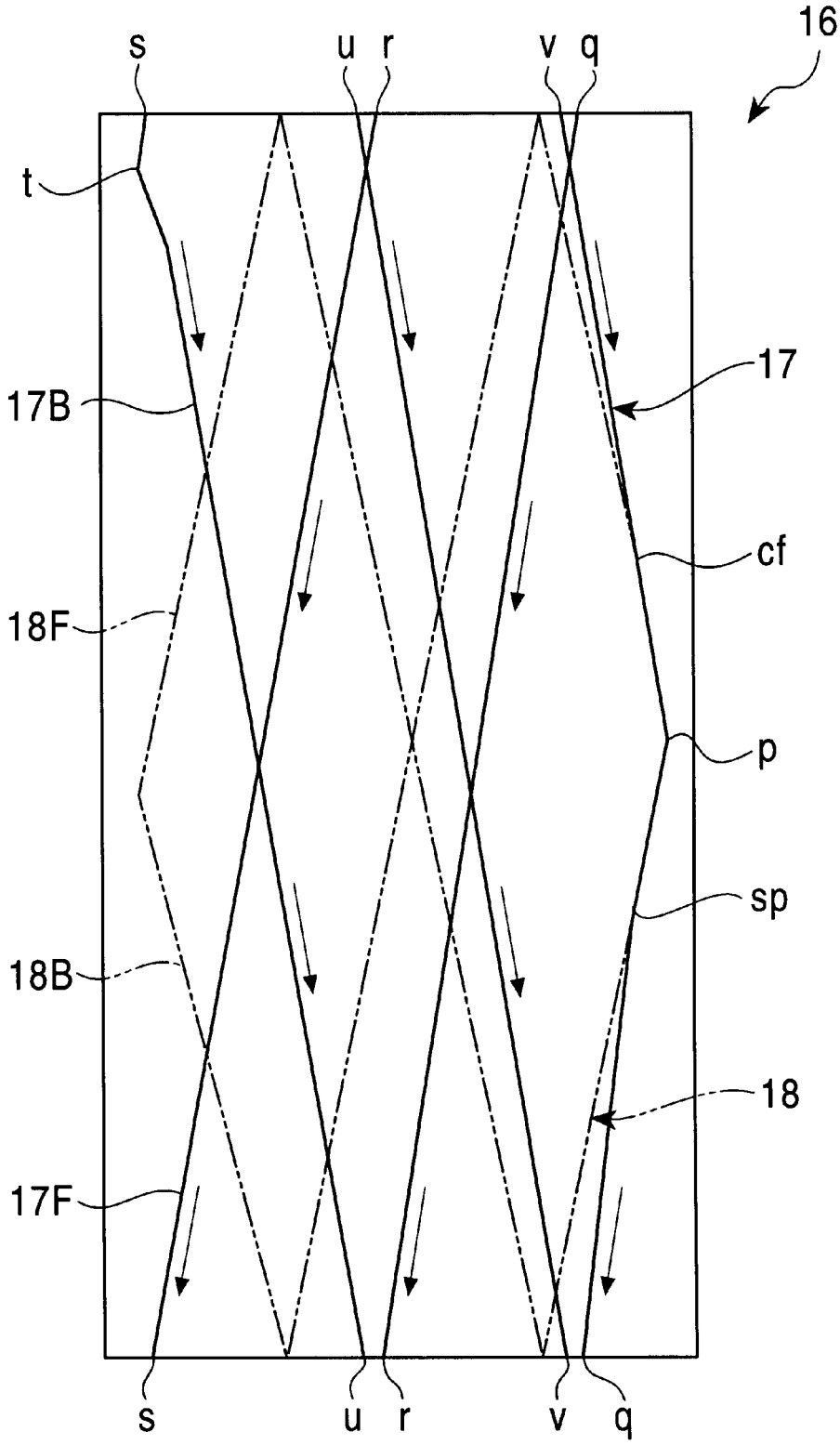
FIG. 8 is a development of another embodiment of a traverse drum showing a yarn path for 2.5 winding values.
Figure 9:
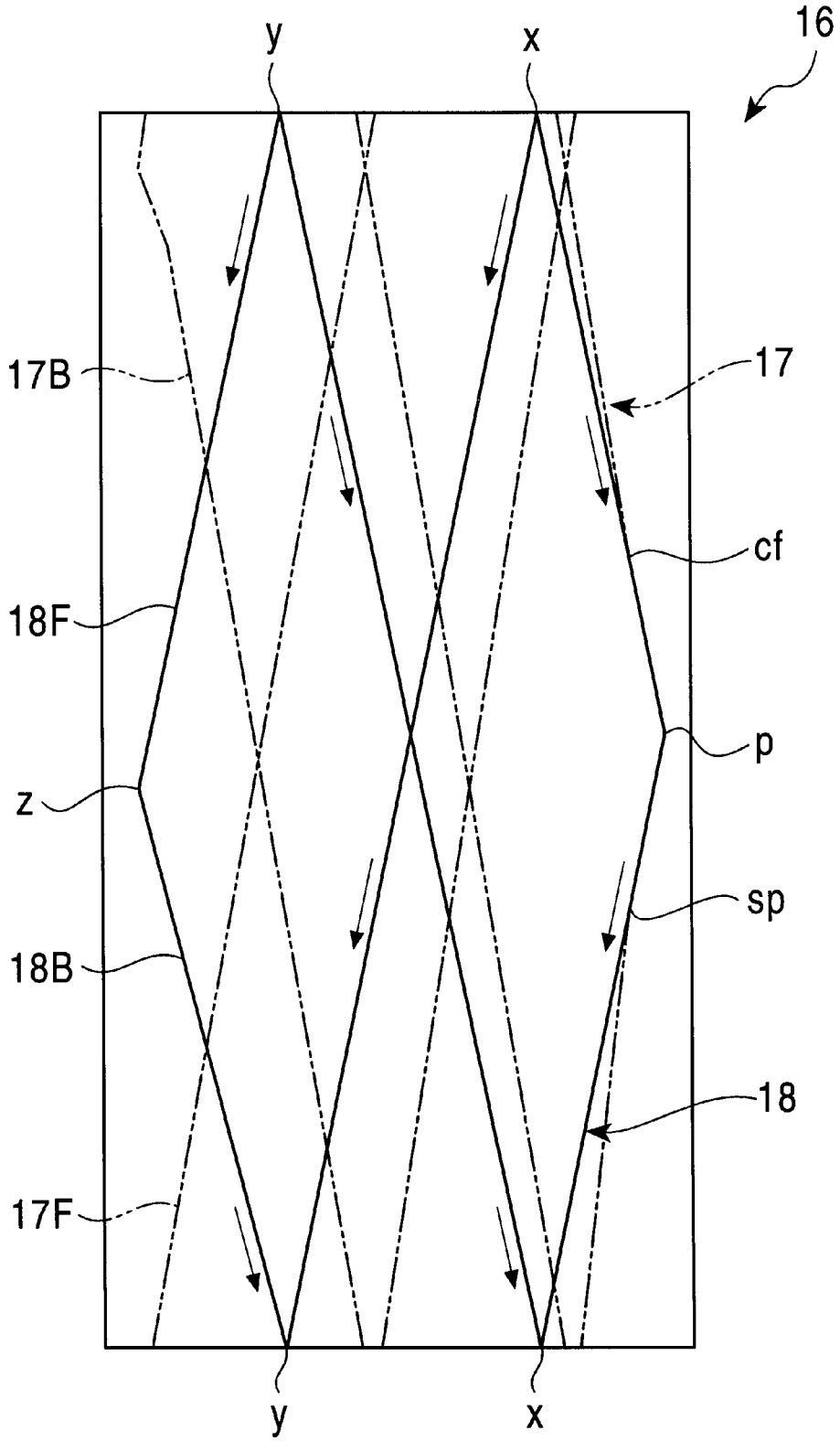
FIG. 9 is a development of further embodiment of a traverse drum showing a yarn path for 2.0 winding values.

For example, a traverse drum 16 shown in FIGS. 8 and 9 comprises a first traverse groove 17 having a first traverse forward path 17F and a first traverse backward path 17B both configured for 2.5W and a second traverse groove 18 having a second traverse forward path 18F and a second traverse backward path 18B both configured for 2.0W.

In this embodiment, the two continuous traverse grooves 17, 18 for different winding values are formed completely independently.

First, the first traverse groove 17 through which the yarn Y is traversed at 2.5W will be explained with reference to FIG. 8.

If the yarn Y is traversed using a right-end point (p) as a starting point, the yarn Y passes through the first traverse groove 17 as the traverse drum 16 rotates, that is, it moves from the point (p) through a separating point (sp) to a point (q). The yarn Y then moves from the point (q) to a point (r), then from the point (r) to a point (s), and then from the point (s) to a point (t) to reach a left end of the traverse drum 16.

That is, the first traverse groove 17 joining the point (p) and point (t) through the separating point (sp) and the points (q), (r), (s) constitutes the traverse forward path 17F. Since the leftward movement of the yarn Y from the point (p) to the point (t) causes the traverse drum 16 to be rotated 2.5 times, a drum winding value for the traverse forward path 17F is 2.5W.

The yarn Y further passes through the first traverse groove 17 as the traverse drum 16 rotates, in this case, it moves from the point (t) to a point (u), then from the point (u) to a point (v), and then from the point (v) to the point (p) through the confluence (cf) to reach the right end of the traverse drum 16. That is, the first traverse groove 17 joining the points (t), (u), (v), (cf), (p) constitutes the traverse backward path 17B. Since the rightward movement of the yarn Y causes the traverse drum 16 to be rotated 2.5 times, a drum winding value for the traverse backward path 17B is 2.5W.

As described above, the traverse forward path 17F of the first traverse groove 17 is adapted for 2.5W, while the traverse backward path 17B of the first traverse groove 17 is adapted for 2.5W.

Next, the second traverse groove 18 through which the yarn Y is traversed at 2.0W will be explained with reference to FIG. 9.

If the yarn Y is traversed using the right-end point (p) as a starting point, the yarn Y passes through the second traverse groove 18 as the traverse drum 16 rotates, that is, it moves from the point (p) through the separating portion (sp) to a point (x) shown at the lower end. The yarn Y then moves from a point (x) shown at the upper end to a point (y) shown at the lower end and then from a point (y) shown at the upper end to a point (z) to reach a left end of the traverse drum 16.

That is, the second traverse groove 18 joining the points (p) and (z) through the separating point (sp) and the points (x), (y) constitutes the traverse forward path 18F. Since the leftward movement of the yarn Y from the point (p) to the point (z) causes the traverse drum 16 to be rotated twice, a drum winding value for the traverse forward path 18F is 2.0W.

The yarn Y further passes through the second traverse groove 18 as the traverse drum 16 rotates, in this case, it moves from the point (z) to the point (y) shown at the lower end, then from the point (y) shown at the upper end to the point (x) shown at the lower end, and then from the point (x) shown at the upper end to the point (p) through the confluence (cf) to reach the right end of the traverse drum 16. That is, the second traverse groove 18 joining the points (z), (y), (x), (cf), (p) constitutes the traverse forward path 18B. Since the rightward movement of the yarn Y causes the traverse drum 16 to be rotated twice, a drum winding value for the traverse backward path 18B is 2.0W.

As described above, the traverse forward path 18F of the second traverse groove 18 is adapted for 2.0W, while the traverse backward path 18B of the second traverse groove 18 is adapted for 2.0W.

The first traverse groove 17 and the second traverse groove 18 in the traverse drum 16 do not substantially have a common path and are formed as substantially perfectly independent paths.

In this manner, the traverse drum 16 has the plurality of (in this embodiment, two types of) independent traverse grooves, that is, the first traverse groove 17 and the second traverse groove 18, which have different winding values. Like the above described traverse drum 6, the traverse drum 16 allows the path through which the yarn Y is traversed to be switched at the separating point (sp) to the first traverse groove 17 or the second traverse groove 18.

Figure 10:
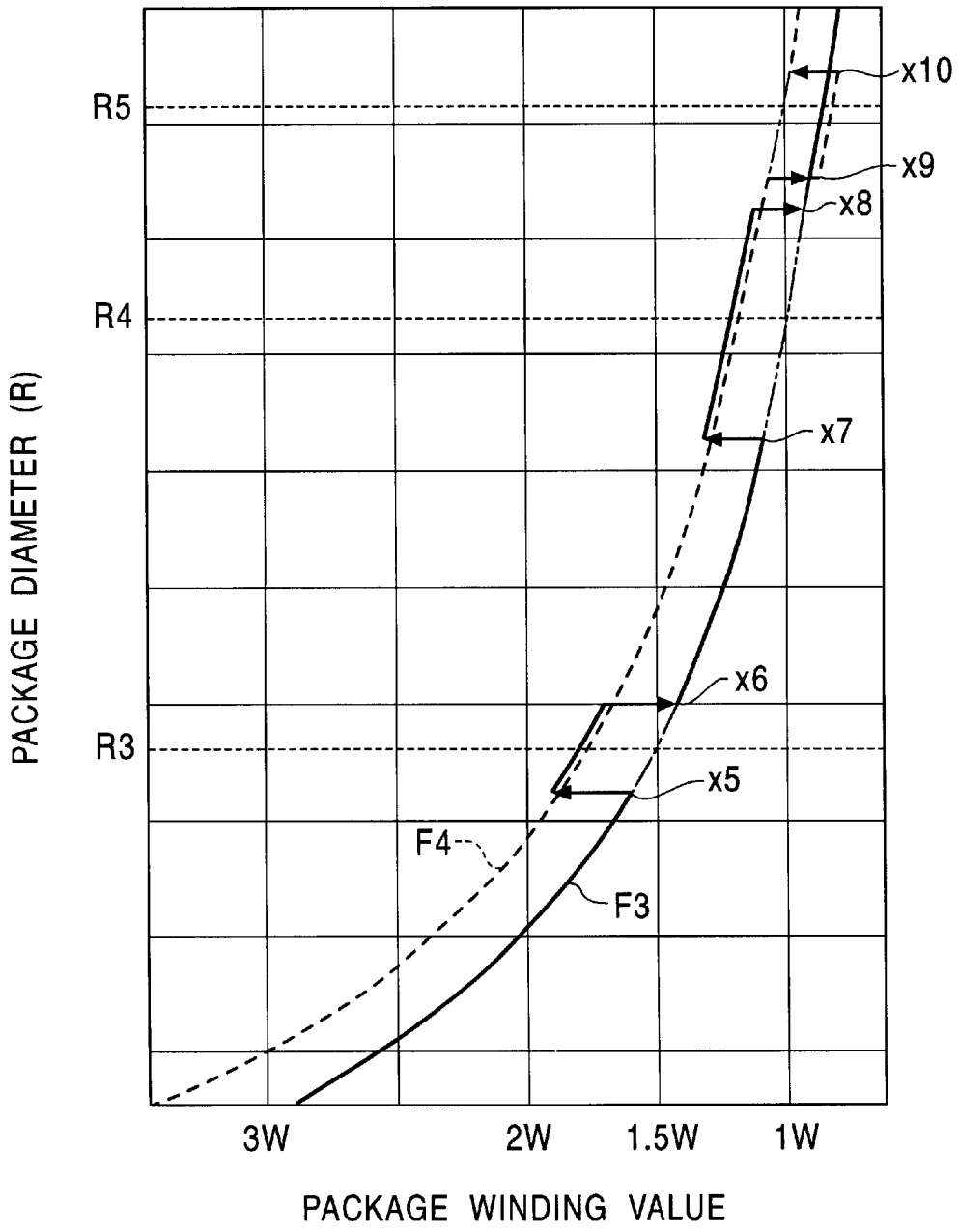
FIG. 10 shows the relationship between the package diameter and the occurrence of a ribbon winding for the traverse drum in FIGS. 8 and 9.

FIG. 10 shows the relationship between the package diameter R and the winding value W of the ribbon winding for the traverse drum 16. A graph F3 shows the relationship between the package diameter R and the package winding value W with the second traverse groove 18 for 2.0W, whereas a graph F4 shows the relationship between the package diameter R and the package winding value W with the first traverse groove 17 for 2.5W.

When the yarn is wound mainly at 2.0W, the winding value is switched to 2.5W when the package diameter is close to R3 at which the 1.5W ribbon winding may occur (between points (x5) and (x6)) and when the package diameter is close to R4 at which the 1W ribbon winding may occur (between points (x7) and (x8)), while 2.0W is used in the other areas, as shown in the graph F3, thereby preventing ribbon winding.

Alternatively, when the yarn is wound mainly at 2.5W, the wining value is switched to 2.0W when the package diameter is close to R5 at which the 1W ribbon winding may occur (between points (x9) and (x10)), while 2.5W is used in the other areas, as shown in the graph F4, thereby preventing ribbon winding.

That is, the present traverse drum 16 enables both winding mainly using 2.0W and winding mainly using 2.5W.

As described above, when the traverse drum 16 is configured so as to have the plurality of continuous independent traverse grooves for different winding values such as 2.0W and 2.5W, the one type of traverse drum 16 can wind the yarn using the plurality of winding values while preventing ribbon winding. As a result, the traverse drum 16 can be generalized.

A package into which the yarn has been wound at 2.0W has a smaller winding density, so that the yarn Y can be dyed while in the form of the package, thereby enabling faster unwinding than in the case of 2.5W or 2.75W.

Since the present invention is configured as described above, it provides the following effects.

In a configuration for using a traverse groove formed in a traverse drum to traverse and wind a yarn into a package, the traverse drum has a plurality of continuous traverse grooves for different winding values formed therein. Consequently, the winding value for the traverse drum can be selected from a range of values.

Means for switching a yarn guide is provided to determine which of the plurality of continuous traverse grooves for different winding values is used to traverse the yarn. As a result, the winding value for the traverse drum can be changed during a winding operation by an automatic winder or the like.

In a configuration for using a traverse groove formed in a traverse drum to traverse and wind a yarn into a package, means for detecting a package diameter at which ribbon winding may occur is provided to effect such control that the winding value for the traverse drum is changed when a package diameter is close to the ribbon winding diameter. Consequently, the winding value must be switched only when the package diameter is close to the ribbon winding diameter, thereby simplifying control to stabilize the winding operation. Additionally, ribbon winding is prevented with the minimum required switching operation, thereby providing an efficient configuration.

The traverse drum has a plurality of continuous traverse grooves formed therein and having different winding values. Accordingly, the one type of traverse drum can wind the yarn using different winding values and can wind the yarn using a plurality of winding values while preventing ribbon winding. As a result, the traverse drum can be generalized.

The plurality of continuous traverse grooves are formed substantially completely independently. Consequently, the plurality of continuous traverse grooves has no common path to allow the single drum to wind the yarn at substantially completely different winding values.

A continuous traverse groove for 2 winding values and a continuous traverse groove for 2.5 winding values are formed. As a result, the traverse drum can be used for dyeing winding and can be generalized.

Half or more of the plurality of continuous traverse grooves are independently formed and a remaining part of the traverse grooves constitutes a common path. Consequently, the amount of traverse grooves can be reduced to facilitate manufacturing of the traverse drum.

A forward and backward portions of at least one continuous traverse groove have different winding values. As a result, ribbon winding can be more effectively prevented.

What is claimed is:

1. A traverse drum including a plurality of continuous traverse grooves formed therein and having different winding values, characterized in that the plurality of continuous traverse grooves are formed substantially completely independently.

2. A traverse drum according to claim 1 characterized in that a continuous traverse groove with a 2 winding value and a continuous traverse groove with a 2.5 winding value are formed.

3. A traverse drum according to claim 2 characterized in that a forward and backward portions of at least one continuous traverse groove have different winding values.

4. The traverse drum according to claim 1, wherein at least two of the continuous traverse grooves intersect at a branching/separating portion.

5. A traverse drum including a plurality of continuous traverse grooves formed therein and having different winding values, characterized in that half or more of each of the plurality of continuous traverse grooves is independently formed and a remaining part thereof constitutes a common path.

6. A traverse drum according to claim 1 or claim 5 characterized in that a forward and backward portions of at least one continuous traverse groove have different winding values.

7. A ribbon winding-preventing method of traversing and winding a yarn into a package, the method comprising:

providing a traverse drum comprising a plurality of continuous traverse grooves formed substantially completely independently;

detecting a package diameter; and changing a winding value of the traverse drum when the package diameter is close to a ribbon winding diameter.

* * * * *